United States Patent [19]

Bhagat et al.

[11] Patent Number: 4,961,882

[45] Date of Patent: Oct. 9, 1990

[54] FINE BUBBLE GENERATOR AND METHOD

[75] Inventors: Phiroz M. Bhagat; Robert M. Koros, both of Westfield, N.J.

[73] Assignee: Exxon Research and Engineering Company, Florham Park, N.J.

[21] Appl. No.: 502,380

[22] Filed: Mar. 30, 1990

Related U.S. Application Data

[63] Continuation-in-part of Ser. No. 367,911, Jun. 19, 1989, abandoned, which is a continuation of Ser. No. 210,550, Jun. 23, 1988, abandoned.

[51] Int. Cl.[5] ..... B01F 3/04

[52] U.S. Cl. ..... 261/124

[58] Field of Search ..... 261/124

[56] References Cited

U.S. PATENT DOCUMENTS

| | | | |
|---|---|---|---|
| 2,007,189 | 7/1935 | Fox | 261/78.2 |
| 2,616,676 | 11/1952 | Walker | 261/124 |
| 2,719,032 | 9/1955 | Schnur | 261/124 |
| 2,868,523 | 1/1959 | Cundiff | 261/124 |
| 3,294,058 | 12/1966 | Shriro | 239/434 |
| 3,539,102 | 11/1970 | Lang | 261/36.2 |
| 3,545,731 | 12/1970 | McManus | 261/122 |
| 3,671,022 | 6/1972 | Laird et al. | 261/124 |
| 3,809,080 | 5/1974 | Deaton | 261/5 |
| 3,893,924 | 7/1975 | Compte, Jr. et al. | 261/124 |
| 3,927,152 | 12/1975 | Kryias | 261/122 |
| 4,117,048 | 9/1978 | Stockner et al. | 261/124 |
| 4,119,686 | 10/1978 | Conger | 261/124 |
| 4,304,740 | 12/1981 | Cernoch | 261/124 |
| 4,415,508 | 11/1983 | Aida et al. | 261/124 |
| 4,629,478 | 12/1986 | Browner et al. | 261/78.2 |
| 4,717,515 | 1/1988 | Forsyth et al. | 261/124 |

FOREIGN PATENT DOCUMENTS

| | | | |
|---|---|---|---|
| 37593 | 4/1886 | Fed. Rep. of Germany | 261/124 |
| 48942 | 1/1965 | Poland | 261/124 |

OTHER PUBLICATIONS

American Heritage Dictionary; Cpr. 1982; pp. 440, 441; Houghton Mifflin Co.

*Primary Examiner*—Tim Miles

*Attorney, Agent, or Firm*—Joseph J. Dvorak

[57] ABSTRACT

In its simplest sense, the present invention provides a method for forming fine gaseous bubbles in a liquid ambient by forcing a gas through orifices located in the liquid ambient to generate a stream of gas bubbles, while simultaneously forcing a liquid through liquid orifices at a velocity sufficient to form jet streams of liquid, the liquid orifices being substantially coplanar with and equal in number to the gas orifices so that each jet stream of liquid intersects each stream of gas bubbles and creates sufficient turbulence, whereby the fine gas bubbles are formed.

9 Claims, 2 Drawing Sheets

FINE BUBBLE GENERATOR AND METHOD

This is a CIP of 07/367,911 filed 6/19/89, now abandoned, which is a Continuation of 07/210,550 filed 6/23/88, now abandoned.

FIELD OF THE INVENTION

The present invention is directed toward the introduction of gas through a non-foraminous orifice, into a liquid ambient in such a way as to generate small gas bubble sizes.

BACKGROUND OF THE INVENTION

The chemical industry utilizes numerous processing techniques in which intimate contact of physically disparate phases is of necessity promoted to optimize the chemical reactions sought to be achieved. Typically, these reactions take place in the liquid phase, and consequently a wide variety of devices have been developed for dispersing gases in liquids.

In typical gas-liquid reactors, a gas is introduced into the bottom of a reactor through an open-ended standpipe, orifices in a horizontally perforated pipe or perforated plate, or through orifices in a perforated sparger ring. The orifices in these devices generally range in size from about ¼ inch to 1 inch. At ordinary gas flow rates, therefore, the size of the gas bubbles generated is also in the range of about ¼ inch to about 1 inch in diameter and, hence, are relatively quite large.

In order to generate smaller bubbles, it is commonly believed that it is necessary to reduce the orifice size. Indeed, foraminous materials, i.e. porous plates and the like that have a plurality of pores all having pore sizes generally less than 1 mm in diameter or length, have been proposed as suitable fine bubble generators. Use of foraminous surfaces as gas bubble generators suffer from several significant disadvantages. Among these is the significant pressure drop associated with use of such devices. Another disadvantage is the ease with which the foraminous material can be fouled or plugged.

Aspirators also have been used for dispersing a gas in a liquid. In these types of devices a liquid is pumped at a rapid rate through a nozzle and the gas is aspirated through a venturi, for example, and thereby dispersed in a liquid stream. In such systems, however, the gas to liquid ratio generally is low, for example, up to about 1:1. Other disadvantages of aspirators are well known.

SUMMARY OF THE INVENTION

In its simplest sense, the present invention provides a method for forming fine gaseous bubbles in a liquid ambient by forcing a gas through orifices located in the liquid ambient to generate for each gas orifice a stream of gas bubbles, while simultaneously forcing a liquid through liquid orifices at a velocity sufficient to form a jet stream of liquid for each liquid orifice, the liquid orifices being substantially coplanar with and equal in number to the gas orifices so that the jet stream of liquid from a liquid orifice intersects a stream of gas bubbles from a gas orifice and creates sufficient turbulence, whereby the fine gas bubbles are formed.

The present invention, of course, has wide applicability to processes in which the intimate contacting of liquid and gaseous phases is required. Thus, in a particularly preferred embodiment of the present invention, a gas liquid mixing device is provided in which a first and second ring-type sparger having orifices therein is positioned in a mixing vessel for separately introducing, in a liquid ambient, a liquid stream through the first and a gas stream through the second sparger into the vessel. The first and second spargers are concentrically oriented and have an equal number of orifices positioned so that when liquid is forced through each liquid orifice, it forms a jet stream that intersects gas forced through each gas orifice in the region of the gas orifice, creating a highly turbulent field in that region, thereby generating bubbles that are finer than what would be generated in the absence of the turbulent field. Preferably, recycled liquid is used in the liquid sparger.

These and other embodiments of the present invention will be more readily understood upon reading of the "Detailed Description of the Preferred Embodiments".

DETAILED DESCRIPTION OF THE PREFERRED EMBODIMENTS

The drawings illustrate a variety of bubble generator configurations based upon the principles of the present invention; namely, forcing two fluids, one a gas and the other a liquid, through separate conduits, each having an equal number of orifices so positioned with respect to each other that the liquid forced through each liquid orifice forms a jet stream of liquid that intersects gas forced through each gas orifice and generates sufficient turbulence in the region of the gas orifices to produce fine, uniformly sized gaseous bubbles in a surrounding liquid ambient.

Figure 1:
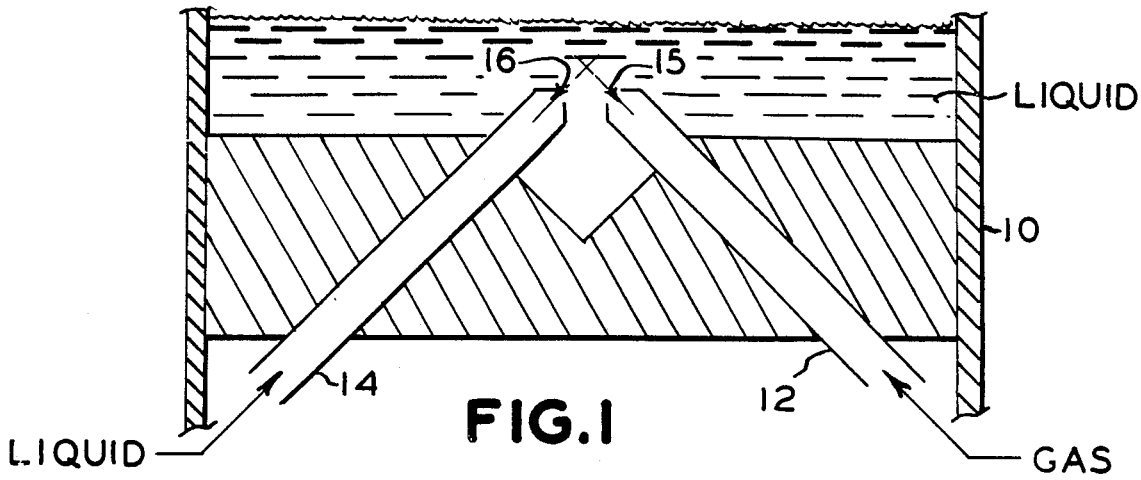
FIG. 1 is a schematic illustration of a bubble generator in accordance with the present invention.

FIG. 1 shows open-ended conduits 12 and 14, respectively, which are arranged within a contacting vessel or a reactor. As shown, the orifices 15 and 16 of conduits 12 and 14, respectively, are oriented with respect to each other so that fluid streams emanating from the orifices will intersect. Thus, in general, the orifices are so oriented as to be at an angle of from about 20° to about 160° with respect to each other. Preferably, the orifices are coplanar and orthogonally opposed; i.e., at about 90° with respect to each other. The conduits are located near the bottom of the liquid ambient column so that the gas introduced into the liquid medium via conduit 12 will flow upwardly through the liquid ambient. Means are provided (not shown) for forcing a gaseous stream through conduit 12 for ejection through orifice 15. Similarly, means are provided for forcing a liquid stream through conduit 14 for ejection through orifice 16. The liquid forced through conduit 14 may be the same or a different liquid from the liquid of the liquid ambient. Typically, the conduits will have orifices greater than about 1 mm in diameter and generally ranging in size from about ⅛ to about 4 inches in diameter.

The flow rates of both gas and liquid through the conduits may be controlled by valves, pumps and the like. Importantly, the liquid is forced through each liquid orifice at a velocity sufficient to create a jet stream of liquid which, when it intersects the gas stream emanating from a corresponding gas orifice, results in sufficient turbulence in the region of the gas orifice, thereby generating finer gaseous bubbles than would otherwise form in the absence of an intersecting jet stream of liquid. Typically, liquid is forced through the liquid orifice at velocities sufficient to ensure that the ensuing jet is turbulent while gas is emitted from the gas orifices at velocities of about 1 to about 100 ft/sec, depending upon the liquid flow rate. In a very typical operation, liquid is ejected through the liquid orifices at about 20 ft/sec while gas is ejected through the gas orifices at about 75 ft/sec.

Figure 2:
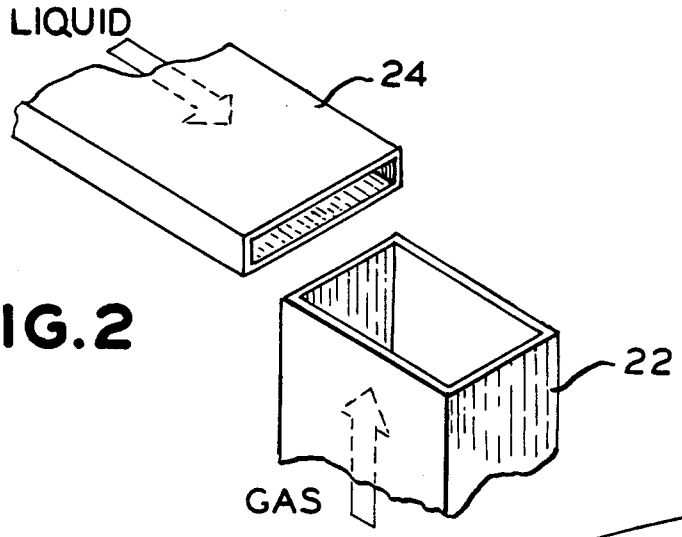
FIG. 2 is a schematic illustration of another form of a bubble generator in accordance with the present invention.

In some instances, it will be preferred to have the gas orifice be significantly larger than the liquid orifice. For example, the ratio of gas orifice area to liquid orifice area may be in the range of from about 1:1 to about 5:1. In this regard, see especially FIG. 2, which shows rectangular gas and liquid conduits 22 and 24, respectively. The orifices in the FIG. 2 embodiment are rectangular in shape, as can be readily seen. Indeed, as shown, the gas orifice has a significantly larger area than the orifice for the liquid conduit 24. Both conduits, of course, are coplanar and have orifices positioned so that the jet stream of fluid ejected from a liquid orifice will intersect a stream of gas from a gas orifice. The larger area for the gas orifice permits discharging gas at lower velocities into the liquid ambient, but nonetheless at flow rates that are greater than the liquid flow rate from conduit 24.

Figure 3:
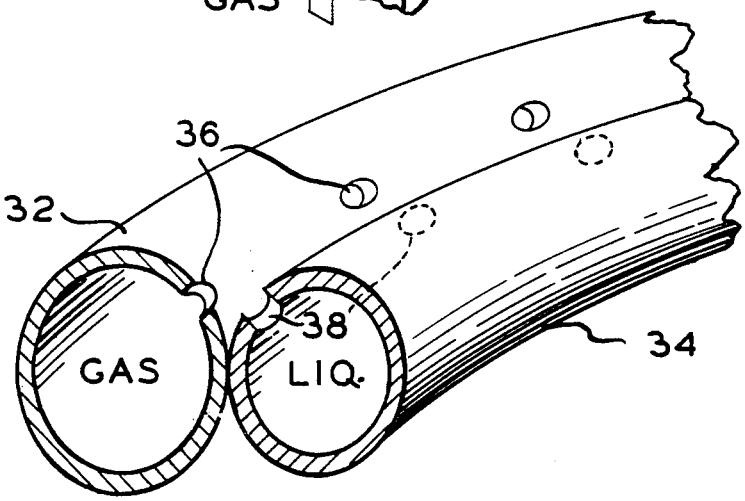
FIG. 3 is a schematic sectional view, partly in perspective, illustrating a double ring sparger bubble generator in accordance with the present invention.

In the embodiment shown in FIG. 3, two concentric tubular rings 32 and 34 are provided with a plurality of orifices 36 and 38. As can be seen, there is a liquid orifice for each gas orifice and the orifices are aligned so that the jet of liquid from a liquid orifice will intersect the gas stream from a gas orifice. Ring 32 as shown is for the gas stream and ring 34 is for the liquid stream.

Figure 4:
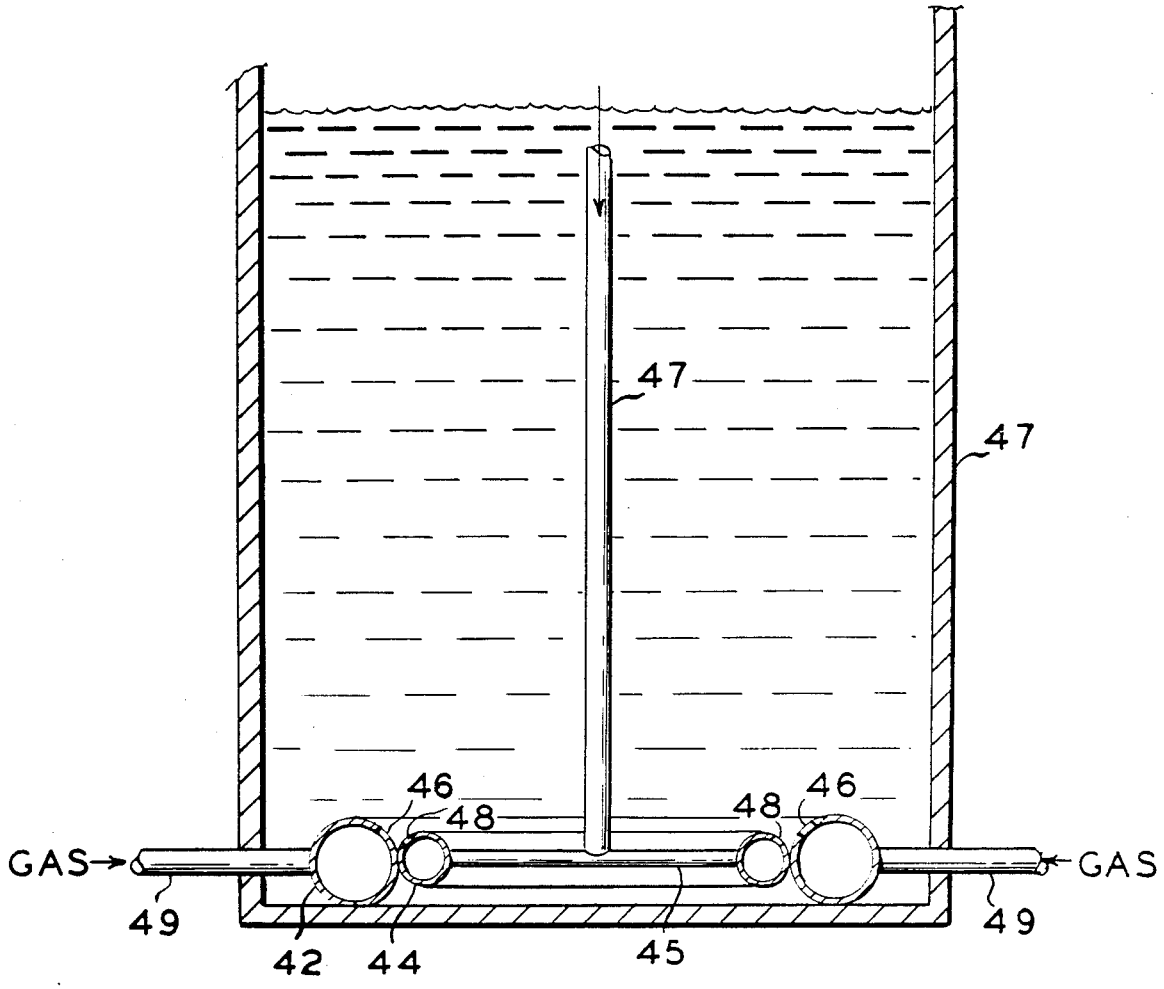
FIG. 4 is a side view of an embodiment of the present invention illustrating a double sparger arrangement, including means for recirculating liquid from the liquid ambient of the liquid sparger.

FIG. 4 shows ring-type spargers 42 and 44 located in the bottom of a column of ambient liquid contained, for example, in a contactor or a reactor having cylindrical sidewalls 10. The orifices 46 and cylindrical sparger 42 are aligned relative to the orifices 48 and the cylindrical liquid sparger 44 so as to be orthogonal with respect to each other. Gas is fed to sparger 42 and is injected into the liquid ambient via orifices 46. Liquid is pumped through the ring sparger 44, vents through orifices 48 at velocities sufficient to form a jet stream of liquid that intersects the gas being injected from sparger 42, thereby generating fine, uniform gaseous bubbles.

As is shown in FIG. 4, a conduit 47 communicates with ring sparger 44 via distributor arms 45 which extend radially from conduit 47. In a particularly preferred embodiment, liquid is recycled from the liquid ambient column via conduit 47 for shearing the gas ejected via orifices 46. Means are also provided for deploying gas to ring 42 such as arms 49.

In a particularly preferred embodiment of the present invention, the bubble ring sparger is located in a bubble or drop column.

The following example will further illustrate the significant features of the present invention.

EXAMPLE

This example illustrates the advantages of a bubble generator of the present invention. For this demonstration, a 3 foot diameter tank containing water was used. The tank was equipped to recirculate the water. Also, at the bottom of the tank two concentric rings were provided for introducing gas and liquid, respectively. The outer ring had slots ½ inch long by ⅛ inch wide facing inwardly, through which gas was forced into the tank. The inner ring had slots ¼ inch long and ⅛ inch wide orthogonally disposed with respect to the gas slots, for introducing shearing liquid. Gas was fed through the gas ring at 84 SCF/min and liquid through the liquid ring at 150 gal/min. After a steady state was reached, the gas and liquid flows to the bubble generator were shut off. Simultaneously, a video record was made of the drop in the level of the tank's contents. Using standard techniques, an analysis of the drop in level as a function of time yielded estimates of the bubble size distribution. The steady state level indicated the average gas hold-up during operation. Comparative data was obtained following the proceeding steps but not introducing shearing liquid. It was established that the bubble generator of this invention reduced the bubble size from ~2 mm to ~0.4 mm while it increased the average gas hold-up from 15% to 30%. Importantly, the interfacial area between the gas and the liquid increases from 4 $cm^2/cm^3$ to 40 $cm^2/cm^3$.

This example also demonstrates that non-foraminous gas orifices, i.e., orifices greater than 1 mm in diameter for circular openings and greater than 1 mm in length for non-circular openings, can be used to generate fine bubbles. Use of relatively large gas and liquid orifices tends to avoid plugging problems and also reduces energy requirements for fluid flow. Other advantages will, of course, be readily apparent to those skilled in the art of bubble generation.

What is claimed is:

1. A method of forming fine gaseous bubbles in a liquid ambient comprising:

forcing a gas through orifices located in the liquid ambient while simultaneously forcing a liquid through liquid orifices at a velocity sufficient to form jet streams of liquid, the liquid orifices being equal in number to the gas orifices and so oriented that each jet stream of liquid intersects the gas forced through each gas orifice and creates sufficient turbulence where the gas and jet stream of liquid intersect, whereby fine gaseous bubbles are formed.

2. The method of claim 1 wherein said liquid is ejected at a velocity sufficient to ensure that the jet stream is turbulent.

3. The method of claim 1 wherein the ratio of the gas to ejected liquid volume is in the range of from about 1:1 to greater than about 20:1.

4. In the process of promoting gas-liquid contacting wherein a gas is forced into a liquid column through orifices in a gas distributor, the improvement comprising forcing a liquid through orifices in a liquid distributor at a velocity sufficient to form jet streams of liquid, the orifices in the liquid distributor being equal in number to the orifices in the gas distributor and oriented so that each jet stream of fluid intersects the gas forced into the liquid column through each gas orifice at an angle of from about 20° to about 160° to create turbulence in the region of the gas orifices, whereby fine gaseous bubbles are formed.

5. The improvement of claim 4 wherein the ratio of the gas to ejected liquid volume is in the range of from about 1:1 to about 20:1.

6. A liquid-gas contacting apparatus comprising:

a vessel for containing a liquid;

a gas conduit located in said vessel and having gas orifices therein so that the orifices will be in a column of liquid under conditions of use;

a liquid conduit located in the vessel and having liquid orifices therein substantially coplanar with the gas orifices, and for each of the gas orifices there being a liquid orifice positioned at an angle of from about 20° to about 160° to the gas orifice;

means for forcing gas through said gas orifices; and means for forcing liquid through said liquid orifices at a velocity sufficient to form turbulent jet streams of liquid that intersect gas forced through the gas orifices whereby fine gaseous bubbles will be generated and flow upwardly in contact with a liquid contacted in said apparatus.

7. The apparatus of claim 6 wherein the liquid orifice for each gas orifice is positioned at an angle of about 90° to the gas orifice.

8. The apparatus of claim 7 wherein the gas distributor is a ring sparger and said liquid conduit is a concentrically located ring sparger.

9. The apparatus of claim 8 including a conduit communicative with said liquid ring sparger for delivering liquid from the liquid column to said liquid ring sparger.

* * * * *